US005303721A

United States Patent [19]

Bowen et al.

[11] Patent Number: 5,303,721

[45] Date of Patent: Apr. 19, 1994

[54] CIGARETTE SNIPPING DEVICE

[75] Inventors: Larry Bowen, Orangeville; Benedict Keaveney, Rexdale, both of Canada

[73] Assignee: Rothmans, Benson & Hedges Inc., North York, Canada

[21] Appl. No.: 37,643

[22] Filed: Mar. 26, 1993

[51] Int. Cl.[5] ..... A24F 13/00

[52] U.S. Cl. ..... 131/248; 131/233; 30/109; 30/112

[58] Field of Search ..... 131/248, 233; 30/90.1, 30/91.2, 109–113

[56] References Cited

U.S. PATENT DOCUMENTS

| | | | |
|---|---|---|---|
| 864,703 | 8/1907 | Sibley | 131/248 X |
| 1,345,935 | 7/1920 | Kostka | 30/109 X |
| 1,459,077 | 6/1923 | Winans . | |
| 1,511,317 | 10/1924 | Beanes | 30/112 X |
| 3,107,674 | 10/1963 | Smith . | |
| 3,851,687 | 12/1974 | Jones | 30/90.1 X |

FOREIGN PATENT DOCUMENTS

| | | | |
|---|---|---|---|
| 2831738 | 2/1979 | Fed. Rep. of Germany | 131/248 |

*Primary Examiner*—Vincent Millin
*Assistant Examiner*—Jennifer Doyle
*Attorney, Agent, or Firm*—Sim & McBurney

[57] ABSTRACT

A planar elongate cigarette snipping device for removing the burnt end of a partially-smoked cigarette to expose fresh tobacco for relighting the cigarette, includes a pair of planar knife blades which are moved from a rest position to an operative position in which they overlap in an aperture through the device, activated by a corresponding pair of arms which are normally biased to the rest position.

6 Claims, 1 Drawing Sheet

CIGARETTE SNIPPING DEVICE

FIELD OF INVENTION

The present invention relates to a device for severing the burnt end of a cigarette which has been extinguished to expose fresh tobacco for relighting the cigarette.

BACKGROUND TO THE INVENTION

Smokers often are required or choose to extinguish a partially-smoked cigarette and the partially-smoked cigarette then is stored for further smoking at a later time. A variety of devices has been proposed which will function both as an extinguisher for the cigarette and as a storage means for the extinguished cigarette.

It is desirable to sever the burnt end of the cigarette to remove the burnt coal. Prior suggestions for devices to achieve this result are contained in U.S. Pat. Nos. 1,459,077 and 3,107,674. These prior devices suffer from the drawback that they do not provide an even cut to the exposed tobacco such that the smoking quality of the cigarettes is not impaired.

SUMMARY OF THE INVENTION

The present invention provides a novel form of snipping device which is compact in design and functions satifactorily to remove the burnt end of a cigarette without impairing the smoking quality of the cigarette.

In accordance with the present invention, there is provided a cigarette snipping device, comprising a planar elongate housing having a hollow interior and an aperture formed through the housing adjacent one longitudinal extremity of said housing and dimensioned to receive a cigarette therethrough.

A pair of planar knife blades is located within the housing and each blade is movable between a rest position in which the respective knife blades are located on opposite sides of but not obstructing the aperture to a degree which would prevent a cigarette from being positioned extending therethrough and an operative position wherein cutting edges of the knife blades overlap sufficiently to sever completely a cigarette positioned extending through the aperture.

A pair of elongate arms extend longitudinally within the housing one adjacent each lateral extremity thereof and connected one to each of the knife blades. The elongate arms normally bias the pair of planar knife blades to their rest position.

Means is provided to permit moving each of the arm means inwardly towards each other to move each of the knife blades from its rest position towards each other and into the operative position. Such means generally comprises cut-away portions of the housing exposing a portion of the arms to permit such inward movement to be effected.

The provision of the pair knife blades operated simultaneously ensures that a uniform cutting action is applied to a cigarette extending through the opening to provide an even cut to the resulting exposed end of the cigarette.

DESCRIPTION OF PREFERRED EMBODIMENT

Figure 2B:
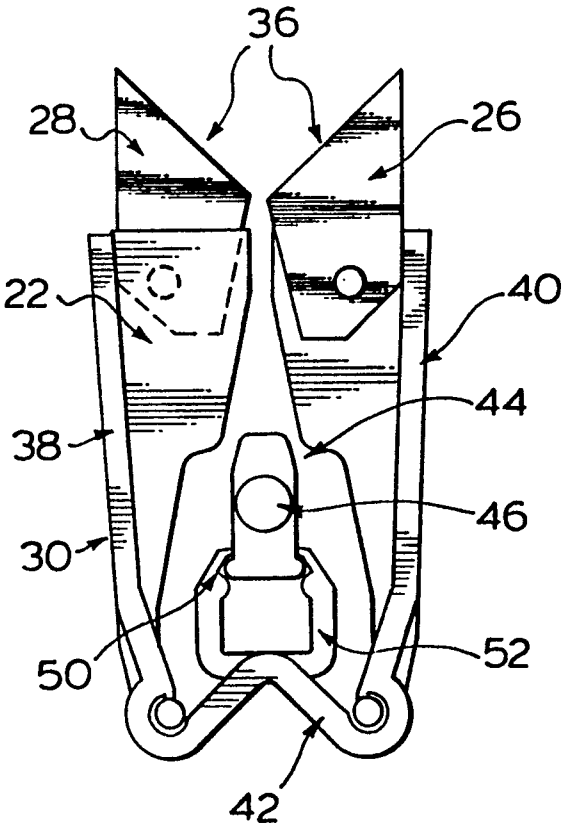
FIG. 2A and 2B is an exploded view of the cigarette snipping device of FIG. 1, showing the component elements.
Figure 2A:
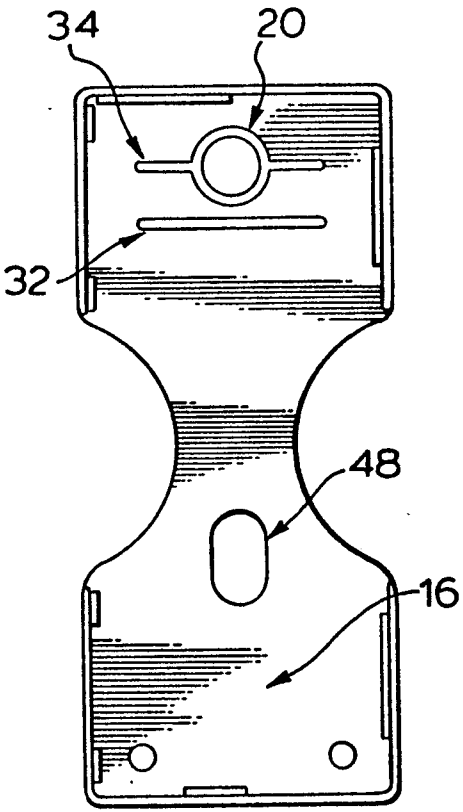

Referring to the drawings, a cigarette snipping device 10 comprises a planar elongate housing 12 having a hollow interior 14. The planar elongate housing 12 comprises two snap-together molded parts 16 (FIG. 2A) which define the hollow interior 14.

The housing 12 is provided with an aperture 18 therethrough comprised of aligned individual openings 20 in the snap-together parts 16. The aperture 18 is dimensioned to permit a cigarette to pass therethrough, preferably in sliding fit so that the walls of the aperture 16 provide support to the cigarette during the cutting action described below.

A cutting mechanism 22 (FIG. 2B) is positioned in the interior of the housing 12. The housing 12 is provided with cut-aways 24 in the lateral extremities, which permit the cutting mechanism 22 to be activated. The cut-aways are illustrated as part-circular, but any other geometric shape may be employed. The cutting mechanism 22 includes a pair of planar knife blades 26, 28 mounted to an activating mechanism 30. The knife blades 26, 28 are positioned in the housing 12 and each is supported between two pairs of upper and lower ribs 32, 34, in sliding fit relation to the housing 12.

Figure 1:
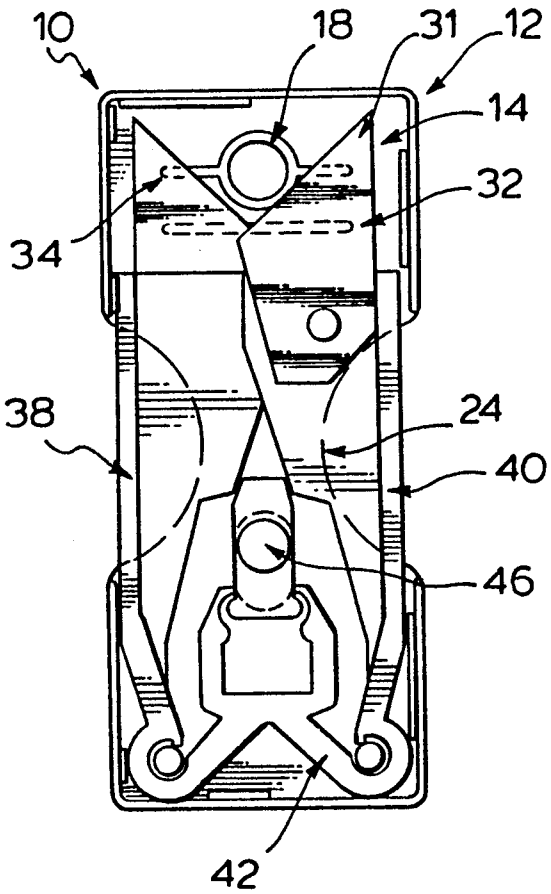
FIG. 1 is a plan view of a cigarette snipping device provided in accordance with one embodiment of the invention.

The knife blades 26, 28 each have a cutting edge 36. In a rest position, as may be seen from FIG. 1, the respective cutting edges 36 of the knife blades 26, 28 are positioned on opposite sides of the aperture 18 and do not obstruct the aperture, so that a cigarette may be positioned extending through the aperture 18.

In the rest position, the respective cutting edges 6 of the knife blades 26, 28 define a V-shaped notch in which the aperture 18 is situated. The cutting edges 36 are arranged at approximately 90 degrees to each other, in order to achieve a very clean cut through the cigarette, as described below. Other relative angular arrangements are possible, for example, from about 45 to about 135 degrees.

The activating mechanism 30 includes a pair of side arms 38, 40, each of which extends longitudinally of the housing 12 along one lateral extremity of the housing 12 and has one of the knife blades 26, 28 mounted thereto. The side arms 38, 40 traverse the cut-away regions 24 of the housing 12, exposing the side arms 38, 40.

The activating mechanism 30 further includes a spring biasing mechanism 42 which is integrally formed with the side arms 38, 40 and causes the side arms 38, 40 normally to be biased towards the lateral extremities of the cutting device and to position the knife blades 26, 28 in their rest position. The spring biasing mechanism 42 includes resilient arms provided in an inverted V-shape.

A safety locking devioe 44 is provided, so as to prevent the device from being activated when not in use. The locking device 44 comprises a pillar or button 46 which extends through a longitudinally-extending elongate opening 48 in each of the snap-together parts 16 to permit the pillar 46 to slide longitudinally in the opening 48. The pillar 46 is integrally formed within an elongate member 48 having an enlarged head 50 at one extremity. This enlarged head 50 is received in engagement with the arms of a yoke 52 joined to the spring biasing arms 42, to prevent inward movement of the arms 38, 40. When released from such engagement by forward movement of the pillar 46 in the elongate slot 48, then the arms 38 and 40 may be moved inwardly to commence a cutting action.

In operation, a cigarette requiring severing, usually to remove an extinguished region of a partially-smoked cigarette, is positioned through the opening 18 to the desired degree, the locking mechanism 46 is released and the arms 38 and 40 are moved inwardly towards each other by the user, causing the knife blades 36 to cut through the cigarette, to expose fresh tobacco for relighting the cigarette. The angular orientation of the knife blades 36 to the cigarette results in a progressive two-dimensional cutting of the cigarette, resulting in a uniform, undeformed end of the severed cigarette.

SUMMARY OF DISCLOSURE

In summary of this disclosure, the present invention provides a cigarette snipping device which is compact, safe and effective. Modifications are possible within the scope of this invention.

What we claim is:

1. A cigarette snipping device, comprising:

a planar elongate housing having a hollow interior, an aperture formed through said housing adjacent one longitudinal extremity of said housing and dimensioned to receive a cigarette therethrough, a pair of planar knife blades located within said housing and each movable between a rest position in which the respective knife blade is located on opposite sides of but not obstructing said aperture to a degree which would prevent a cigarette from being positioned extending therethrough and an operative position on which cutting edges of said knife blades overlap sufficiently to sever completely a cigarette positioned extending through said aperture, a pair of elongate arms extending longitudinally within said housing one adjacent each lateral extremity thereof and connected one to each said knife blade normally biasing said pair of planar knife blades to said rest position, and means to permit moving each said arms means inwardly towards each other to move each said knife blade from said rest position towards each other and into said operative position.

2. The device of claim 1 wherein said means to permit moving said arms comprises cut-aways formed in said housing exposing said side arms.

3. The device of claim 2 wherein said aperture is dimensioned to receive a cigarette in sliding fit relationship therewith.

4. The device of claim 2 including releasable locking means for selectively preventing said arm means from being moved inwardly.

5. The device of claim 3 wherein cutting edges of said knife blades are seated with respect to said aperture so as to define a V-shape with the aperture located within the V-shape.

6. The device of claim 5 wherein said cutting edges are arranged at approximately 90 degrees to each other.

* * * * *